United States Patent [19]

Figone

[11] Patent Number: 4,671,028

[45] Date of Patent: Jun. 9, 1987

[54] INTRINSICALLY HINGED LOAD MEMBER

[76] Inventor: Frank M. Figone, 736½ Jenevein Ave., San Bruno, Calif. 94066

[21] Appl. No.: 638,380

[22] Filed: Aug. 7, 1984

[51] Int. Cl.[4] ..... E04N 12/18; B32B 3/20

[52] U.S. Cl. ..... 52/108; 52/631; 52/806; 428/167; 428/188; 428/906

[58] Field of Search ..... 52/108, 631, 309.1, 52/309.8, 806–808, 309.9, 720; 160/231 A, 231 R; 428/167, 188, 906, 178

[56] References Cited

U.S. PATENT DOCUMENTS

| | | | |
|---|---|---|---|
| 3,084,403 | 4/1963 | Elmendorf | 160/231 R |
| 3,274,315 | 9/1966 | Kawamura . | |
| 3,339,326 | 5/1967 | Derr et al. | 52/808 X |
| 3,379,221 | 4/1968 | Harry et al. | 52/806 X |
| 3,425,889 | 4/1969 | Willits, Jr. | 52/631 X |
| 3,527,283 | 9/1970 | Butler et al. | 160/231 A X |
| 3,710,529 | 1/1973 | Pass | 52/108 |
| 3,715,846 | 2/1973 | Sullhofer | 52/309.9 |
| 3,717,247 | 2/1973 | Moore | 52/108 X |
| 3,925,943 | 12/1975 | Petrie | 52/108 |
| 3,958,385 | 5/1976 | Bondra, Jr. et al. | 52/631 X |
| 4,027,715 | 6/1977 | Tohma | 52/108 X |
| 4,453,357 | 6/1984 | Zwilgmeyer | 52/309.1 X |

FOREIGN PATENT DOCUMENTS

| | | | |
|---|---|---|---|
| 1455845 | 9/1966 | France | 52/806 |
| 260801 | 4/1949 | Switzerland | 52/631 |
| 358926 | 1/1962 | Switzerland | 160/231 A |

*Primary Examiner*—William F. Pate, III
*Assistant Examiner*—R. Chilcot
*Attorney, Agent, or Firm*—Flehr, Hohbach, Test, Albritton & Herbert

[57] ABSTRACT

An intrinsically hinged structural member is disclosed which can easily be bent, rolled or folded in one direction while exhibiting high resistance to bending, rolling or folding in the opposite direction. The general form of the structural member comprises a continuous side wall, a plurality of inner walls and a segmented outer wall. The inner walls confining cavities extending through the member. The slits in the segment outer wall define confronting faces which when forced together under stress exhibit a high resistance to any further bending or folding of the segment wall. Preferably, the confronting faces are complementary; the complementary faces which comprise male and female portions may periodically alternate from one side of the slit to the other to provide further resistance to torsional stress.

20 Claims, 30 Drawing Figures

INTRINSICALLY HINGED LOAD MEMBER

This invention relates generally to a hollowed plastic structural element, and more particularly to an intrinsically hinged structural member which provides a high resistance to folding in one direction.

A number of efforts have been made to create products that are sufficiently stiff to provide a relatively high strength in use as a support while being foldable for transport or storage. However, such known systems have typically relied on labor intensive inflatable bladders or bellows, mechanical slip joints or flexible materials in conjunction with removable stiffeners or tensioning lines. It is an objective of the present invention to provide an improved structural member which can be bent easily in one direction, while resisting folding or rolling when loaded in the opposite direction.

Packaging material or support materials which can be rolled or folded for shipment or storage have been previously developed, as shown example in U.S. Pat. No. 2,518,510 or U.S. Pat. No. 3,935,357. However, in both these patents, the packaging material has minimal resistance to deformation when loaded in the opposite direction to the folding direction. Therefore, the materials disclosed in these patents are useful only for wrapping or the like, and have no intrinsic structural support. Some efforts have been made to provide a flexible material which when in use does have some inherent support. Examples of this are shown in U.S. Pat. Nos. 4,054,702; 4,209,043; or 4,291,083. However, in all of these patents, the material either must be wrapped upon itself several times to have any structural strength (as shown in the U.S. Pat. No. 4,054,702) or portions of the material must be overlapped and joined together by hand. Materials shown in these patents are difficult to extrude and require considerable amounts of hand labor to be formed into a useful shape.

It is an objective of the present invention to provide an intrinsically hinged structural member which is easy to extrude, cast or otherwise process.

It is a further objective of the present invention to provide a structural member which is easily folded or rolled when loaded in one direction, while providing a stiff and sound structure when loaded in the opposite direction.

A further deficiency of the plastic materials shown in the prior art is that all are highly susceptible to twisting or breaking down, when subjected to torsional stresses.

It is an objective of the present invention to provide an intrinsically hinged structural member which when loaded in the direction which is intended to resist deformation inherently incorporates resistance to unequal stress loads and deformation due to twisting under such loads.

These and other advantages are achieved in the present invention which comprises an intrinsically hinged structural member which when viewed in cross-section comprises a continuous outer wall portion, a plurality of inner walls and a segmented outer wall. The slits in the segments of the outer wall defining confronting faces which when the continuous wall is placed under load, abut and resist any further deformation under such load. In preferred forms of the invention, the abutting confronting faces are complementary so that they interlock under load, reducing the shearing potential of the material and also significantly reducing the deformation of the member under an applied load.

In preferred forms of the invention, a webbing may be stretched between each internal wall near the mouth of the slit to seal off the internal cores of the member from the slit opening. In another preferred form of the invention, the male and female portions of the abutting faces periodically reverse sides of the slit, thereby increasing the resistance to torsional deformation. In another preferred form, rather than have the slits extend linearly through the body of the member, portions of each slit are offset to one side or the other of the slit, creating a design which further resists torsional deformation.

In addition to its utility as a supporting structural member which is easily folded and transported, the intrinsically hinged structural member may find considerable utility as a flexible hinge between two non-flexible members by providing means for joining the internal walls on either side of the slit portion to the non-flexible members which it is desired to hinge together.

The objectives and advantages of the present invention can be better understood by the following detailed description which is given with reference to the drawings in which.

Figure 1:
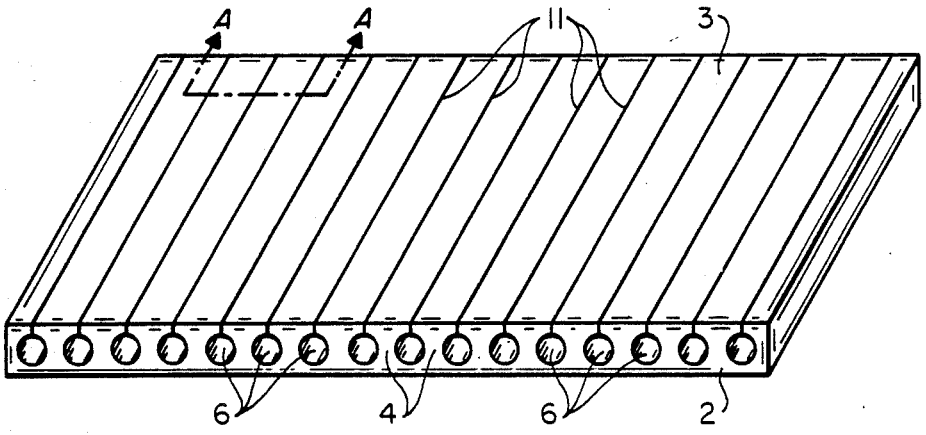
FIG. 1 is a perspective view of a structural member in accordance with this invention.
Figure 25:
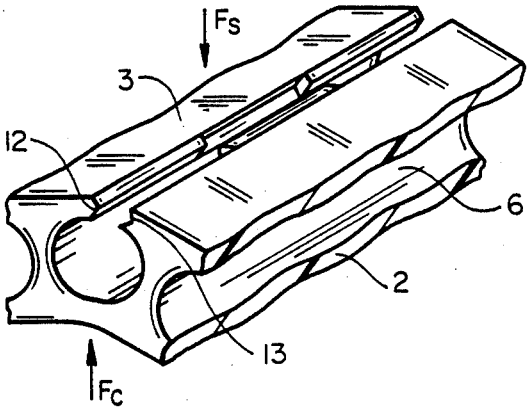
FIG. 25 is a prospective view of an intrinsically hinged structural member including periodic alternation of the multiplanar faces.

Referring to FIG. 1 which is a plan view of the most general form of the structural member of this invention, it can be seen that the structural member comprises a continuous bottom or outer wall 2, a segmented outer or top wall 3, and internal walls 4 running between the top and bottom walls defining cavities 6 which run the width of the member. Slits or notches 11 run the width of the structural member, defining confronting faces or sides 12, 13 as can be best seen in the perspective view of FIG. 25. The confronting sides 12 and 13 extend down to meet the cavities 6 which run through the member. As a result, when a load or force is placed against the continous wall 2, (as represented by the arrow $^{F}$C in FIG. 25) the segmented wall 3 can bend as shown in FIG. 25. In this way, the member can be rolled up for movement or storage.

If the load is placed against the segmented wall 3 (as shown by arrow $^{F}$S, then the confronting surfaces 12 and 13 meet and resist any bending or rolling of the structural member. The ability of what may be called an intrinsically hinged structural member (called intrinsically hinged because of its ability to bend, roll or fold in one direction, i.e., away from the segmented side while exhibiting high resistance to bending or folding in the opposite direction, i.e., toward the segmented side) is due to the different "area moment of inertias" of the two directions. When bending the member in the direction such that the slits or notches 11 open up (as shown in FIG. 25), the continuous side 2 is all that is resisting bending, thereby yielding a relatively small area moment of inertia. When bending the member in the opposite direction such that the confronting sides 12 and 13 abut each other, loading the slit or notch side 3 in compression and loading the continuous side 2 in tension, the member yields a relatively large area moment of inertia.

A quantitative example would be a 0.6 inch thick intrinsically hinged structural member with 0.08 inch thick outside wall 2, 3 on the continuous and segmented sides; this member would have more than 200 times the area moment of inertia in one direction than in the opposite direction. Theoretically, this equates to more than 200 times the stiffness in one direction as in the opposite direction, assuming that the tensile and compressive moduli of the constructing material are equivalent. This directional stiffness ratio is independent of the material used to construct provided that the above assumption is met. That is, the intrinsically hinged member will exhibit the same behavior regardless of the material used to construct the member. Of course, for certain purposes, the function of the structural member can be modified by selection of a material having appropriate tensile and compressive moduli.

Figure 2:
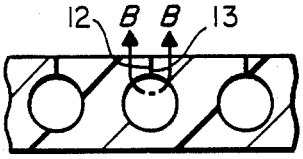
FIG. 2 is a sectional view taken on lines A—A of FIG. 1.

FIG. 2 is a sectional view taken on the line A—A of FIG. 1; this is the simplest form of the invention. A number of variations on this section are possible, many of which have significant inherent advantages. To optimize the utility of the intrinsically hinged structural member for a given application, the correct material and cross-sectional design must be selected based on the expected folding force in the one direction, the required stiffness in the other direction, the weight, the ease of manufacturing the design, and other criteria. Therefore, variations on the design shown in FIG. 2 appear in FIGS. 3 through 12 showing different designs for the cores or cavities 6 which may extend through the structural member.

Figure 3:
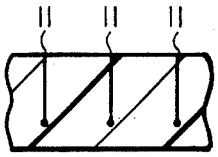
FIGS. 3–11 are illustrative sectional views of geometric variations of FIG. 2.
Figure 4:
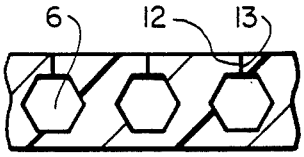
Figure 5:
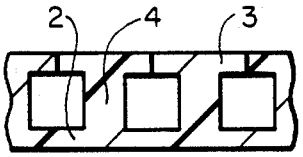
Figure 6:
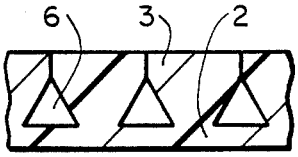
Figure 7:
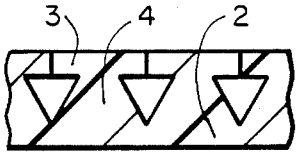
Figure 8:
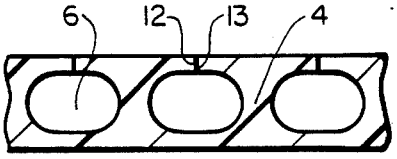
Figure 9:
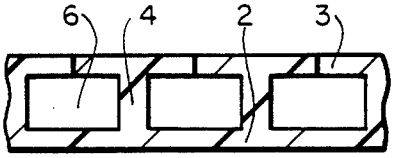
Figure 10:
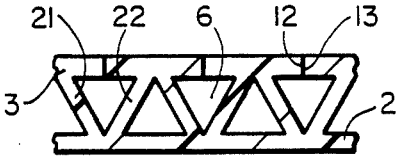

Obviously, FIG. 3 is even simpler to manufacture, but lacks many of the advantages of the present invention. The embodiments shown in the other figures are lighter in weight.

Figure 11:
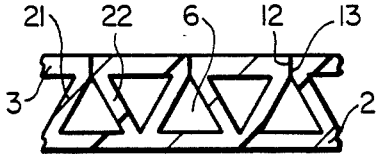

In the embodiment of FIG. 11, alternating pairs of walls 21, 22 slope toward each other. This enhances the ability of the continuous side to be bent in the direction of that side, while maximizing the reinforcement of both sides. The reinforcing strut walls hold the faces 12 and 13 in alignment.

Figure 12:
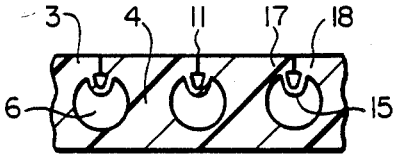
FIG. 12 is a sectional view similar to FIG. 2 except showing the internal webbing feature of the present invention.

The design of FIG. 12 includes a web 15 extending between a pair of walls portions 17, 18, to isolate the slit from the interior of the cavity 6. This may be desirable to prevent the cavity from filling with foreign material which may occasionally pass over the slits.

Figure 13:
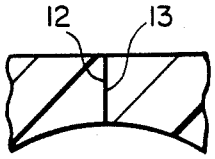
FIG. 13 is an enlarged sectional view of the portion between lines B—B of FIG. 2.
Figure 14:
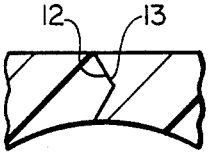
FIGS. 14–19 are views of alternative embodiments to the embodiment of FIG. 13.
Figure 15:
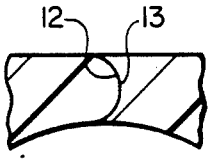
Figure 16:
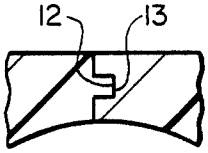
Figure 17:
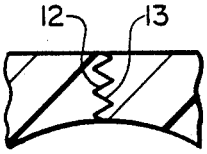
Figure 18:
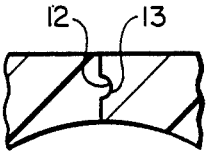
Figure 19:
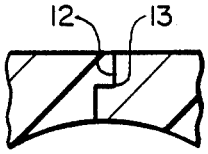

FIG. 13 is an enlarged sectional view on the line B—B of FIG. 2 depicting the slit design which is the easiest and least expensive version to produce. However, the drawback to the simple design of FIG. 13 is that the member is more likely to prematurely fail by buckling or shearing out of the confronting faces 12 and 13. Therefore, it is highly advantageous to use a multiplanar design for the two confronting faces such as shown in FIGS. 14 through 19. These faces each include male and female sides 12 and 13 which are complimentary to each other. All of the embodiments of FIGS. 14 through 19 have multiplanar faces. Some embodiments provide an especially tight interlock such as the notch and recess arrangement of FIG. 16; others are especially easy to manufacture such as the triangular or semi-circular embodiments of FIGS. 14 and 15. In all of the cases where complementary multiplanar faces are used for the two confronting faces, the ability of the intrinsically hinged structural member to resist buckling or shearing failure on the segmented side is significantly increased.

In a highly desirable alternative embodiment, the male and female complementary faces may alternately switch sides of the slit. This increases the ability of the structural member to resist twisting or tortional forces which could otherwise cause failure of the structural member.

Figure 20:
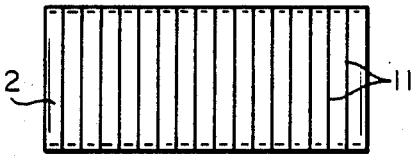
FIG. 20 is a plan view of the structural member shown in FIG. 1.
Figure 21:
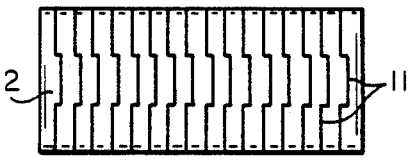
FIGS. 21–24 are plan views of alternate embodiments to the embodiment shown in FIG. 20.
Figure 22:
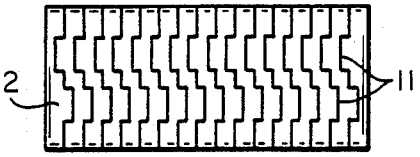
Figure 23:
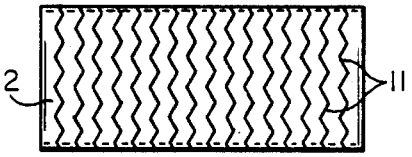
Figure 24:
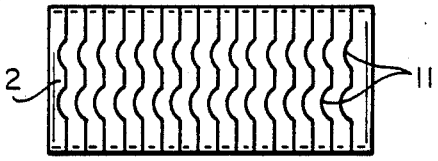

FIG. 20 is a top view or plan view of the device of FIG. 1 which is the least expensive version of the device to produce in that the slits 11 are all linear, i.e., they run in straight lines parallel across the surface of the segmented side. As shown in FIGS. 21–24, further torsional stiffness may be achieved and relative motion between adjacent segments minimized when under torsional load, by displacing the slit 11 to either side of the basic linear alignment. The offset may always be to the same side as shown in FIG. 21; or alternate sides as shown in FIG. 22, or the offset may describe a sawtooth pattern as shown in FIG. 23; or describe a segment of a circle as shown in FIG. 24.

Figure 26:
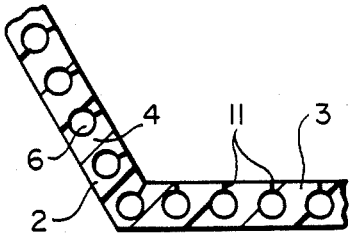
FIGS. 26 and 27 are sectional views of non-planar structural members made in accordance with the present invention.
Figure 27:
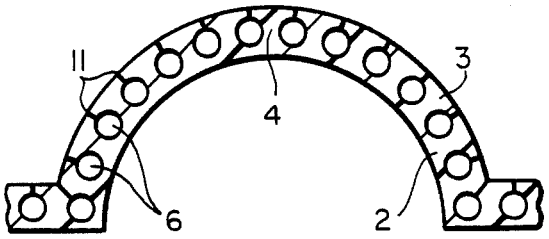

The intrinsically hinged structural member of the present invention can be employed in a myriad of configurations such as in FIG. 26 where a corner is illustrated in a cross-sectional view, or FIG. 27 where the structural member describes a segment of a circle. In either event, resistance to bending toward the slit side is achieved.

Figure 28:
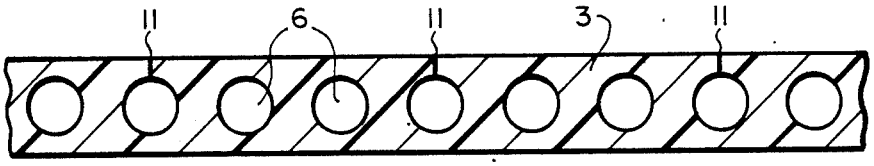
FIG. 28 is a sectional view of a structural member with increased segment size.
Figure 29:
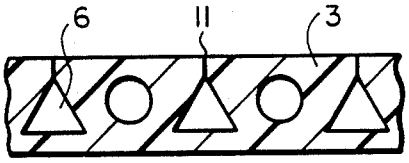
FIG. 29 is a sectional view of a structural member using a mixture of cores extending through the member.

In the embodiments of FIGS. 28 and 29, the slit segments on the segmented side do not occur parallel with every void, but only with voids at regular intervals. This increases the ability to keep the confronting faces 12, 13 of adjacent segments in alignment. The use of cores having different cross-sectional areas can also provide advantages in maximizing alignment while minimizing the weight of the structural member.

Figure 30:
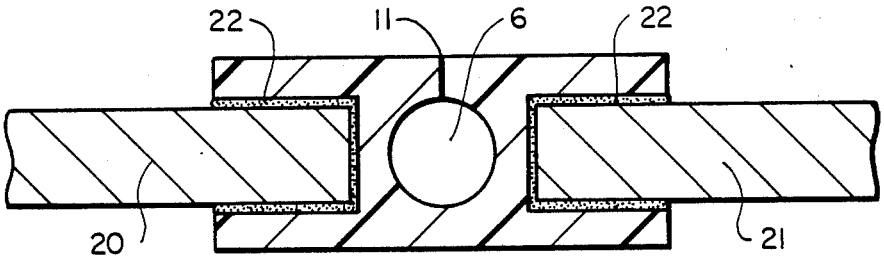
FIG. 30 is a sectional view of a structural member bonded to fixed structural member designs to function as a hinge between the fixed members.

FIG. 30 illustrates a particular use of the intrinsically hinged structural member which may have advantages in many embodiments. In this figure, the structural member is bonded to a pair of static members 20, 21 through a bonding agent such as an adhesive 22. In this manner, the structual member may be used as a very easily constructed hinge between two static members.

Other uses of the present invention may be devised by a person of skill in the art who studies the above specification and figures. Therefore, the scope of the present invention is to be limited only by the following claims.

What is claimed is:

1. An intrinsically hinged unitary structural member comprising when viewed in cross-section a first continuous outer wall portion, a plurality of inner walls and a second outer wall including slits forming segments in said outer wall, said slits defining confronting faces extending through said outer wall to allow bending of said structural member along said continuous wall, said confronting faces abutting to inhibit bending of said member toward said segmented wall, said confronting faces comprising complementary, multi-planar interlocking surfaces for minimizing buckling and shearing movement along said confronting faces, said inner and outer walls defining a plurality of parallel hollow cores through said structural member, said complementary portions of said confronting faces periodically alternating sides of said slit, whereby said member has increased resistance to torsional stress.

2. A structural member as claimed in claim 1 wherein said confronting surfaces comprise a protrusion on one of said surfaces and a recess on the other of said surfaces.

3. A structural member as claimed in claim 1 wherein said slits include portions offset from one side of the member to the other.

4. A structural member as claimed in claim 1 wherein said confronting faces have complementary mated portions to minimize buckling and shearing.

5. A structural member as claimed in claim 1 wherein said internal walls define a plurality of parallel cavities extending across said member.

6. A structural member as claimed in claim 1 further including a webbing extending between each pair of inner walls, isolating said slit defined by said confronting faces from the internal cavities defined by said inner walls.

7. A structural member as claimed in claim 5 wherein alternate pairs of said internal walls are angled toward each other, said slits extending into alternating ones of the cavities defined by said walls.

8. A structural member as claimed in claim 1 wherein one of said complementary faces, as viewed in cross-section, comprises a segment of a circle.

9. A structural member as claimed in claim 1 wherein one of said complementary faces, as viewed in cross-section, comprises two equal sides of a triangle.

10. A structural member as claimed in claim 9 wherein one of said complementary faces, as viewed in cross-section, comprises a tooth protruding from the center of the plane of the face.

11. A structural member as claimed in claim 10 wherein said tooth comprises a segment of a circle.

12. A structural member as claimed in claim 3 wherein each of said offsets is to the same side of the linear path of the slit.

13. A structural member as claimed in claim 3 wherein said offsets are to alternate sides of the linear path of the slit.

14. A structural member as claimed in claim 3 wherein said offset portions of said slit appear as segments of a circle.

15. A structural member as claimed in claim 1 further comprising means outside of said inner walls for bonding said member to static structural members, whereby said structural member is adapted to function as a hinge.

16. An intrinsically hinged unitary structural member adapted to bending easily in one direction and resist bending in the other direction, comprising when viewed in cross-section, a first continuous outer wall portion, a plurality of substantially parallel inner walls defining cavities extending through said member parallel to the direction of bending, a second outer wall including slits forming segments in said outer wall defining confronting complenetary multi-planar faces, said slits extending through said outer wall into said cavities, said member bending easily toward said continuous wall, said complementary portions of said confronting faces abutting to inhibit bending toward said segmented wall, said complementary portions of said confronting faces periodically alternating sides of said slit, whereby said member has increased resistance to torsional stress.

17. A structural member as claimed in claim 16 wherein said slits include portions offset from a straight line from one side of the member to the other.

18. A structural member as claimed in claim 16 further including a webbing extending between each pair of inner walls, isolating said slit defined by said confronting faces from the internal cavities defined by said inner walls.

19. A structural member as claimed in claim 16 wherein alternate pairs of said internal walls are angled toward each other, said slits extending into alternating ones of the cavities defined by said walls.

20. A structural member as claimed in claim 16 further comprising means outside of said inner walls for bonding said member to static structural members, whereby said structural member is adapted to function as a hinge.

* * * * *